US005233574A

United States Patent [19]

Walder et al.

[11] Patent Number: 5,233,574

[45] Date of Patent: Aug. 3, 1993

[54] WRISTWATCH CASE INCLUDING A BACK COVER RISING ALONG THE CASEBAND

[75] Inventors: Pierre-Alain Walder, Bienne; Leonhard Meister, Selzach, both of Switzerland

[73] Assignee: Montres Rado S.A., Lengnau, Switzerland

[21] Appl. No.: 896,390

[22] Filed: Jun. 10, 1992

[30] Foreign Application Priority Data

Jun. 27, 1991 [CH] Switzerland ..... 1899/91

[51] Int. Cl.[5] ..... G04B 37/00; G04B 39/00

[52] U.S. Cl. ..... 368/276; 368/294; 368/309

[58] Field of Search ..... 368/88, 276, 280, 286, 368/294, 296, 309

[56] References Cited

U.S. PATENT DOCUMENTS

| | | | |
|---|---|---|---|
| 2,367,091 | 1/1945 | Bloth | 58/105 |
| 3,242,664 | 3/1966 | Lederrey | 58/88 |
| 4,198,811 | 4/1980 | Ratajski | 368/292 |
| 4,620,798 | 11/1986 | Scarlini | 368/276 |
| 4,623,262 | 11/1986 | Gogniat et al. | 368/294 |
| 4,924,453 | 5/1990 | Ray et al. | 368/294 |
| 4,979,157 | 12/1990 | Gogniat | 368/276 |
| 4,995,023 | 2/1991 | Muller et al. | 368/276 |
| 5,033,035 | 7/1991 | Affolter | 368/294 |

FOREIGN PATENT DOCUMENTS

| | | |
|---|---|---|
| 64-9889 | 6/1985 | Switzerland . |
| 65-2885 | 12/1985 | Switzerland . |
| 65-4167 | 2/1986 | Switzerland . |

*Primary Examiner*—Vit W. Miska

*Attorney, Agent, or Firm*—Griffin, Butler, Whisenhunt & Kurtossy

[57] ABSTRACT

A wristwatch case includes a caseband (12) which receives a movement (2) surmounted by a dial (3). A crystal (5) and a back cover (6) are secured to the caseband as well as first (7) and second (8) bracelet strands. The back cover entirely covers over the underside of the caseband and includes first (9) and second (10) integrally formed wings. Such wings cover over entirely the outer sides (11) exhibited by the caseband and which are found situated between the bracelet strands. The back cover is preferably made of ceramic material.

8 Claims, 5 Drawing Sheets

WRISTWATCH CASE INCLUDING A BACK COVER RISING ALONG THE CASEBAND

The present invention concerns a wristwatch case including a caseband arranged to accommodate a movement surmounted by a dial and hands for indicating the time of day, a crystal and a back cover secured to the caseband and a bracelet including first and second strands attached to said caseband respectively at 6 o'clock and at 12 o'clock.

BACKGROUND OF THE INVENTION

A host of possibilities are available to whoever wishes to propose a watchcase which comprises the elementary components enumerated in the generic definition given hereinabove. In the case in which it is sought to give the case a high class aspect, whilst desiring an excellent resistance for it having regard to external stresses which may arrive, in particular resistance to scratches, one may make use for example of a sapphire crystal and provide the caseband with an external cap of extra hard material such as is shown in the patent CH-A-517 963 (U.S. Pat. No. 3,242,664). In this embodiment, however, the back cover is of steel and its aspect may rapidly deteriorate. Likewise the cap which dresses the caseband is of massive aspect as much from the standpoint of weight as from that of appearance.

SUMMARY OF THE INVENTION

In order to overcome such disadvantages, the case of the present invention, in addition to including the elements enumerated in the first paragraph hereinabove, is characterized in that the back cover entirely covers over the caseband underside, and includes first and second integrally formed wings, said wings extending at least to cover over entirely the outer sides exhibited by the caseband, and which are found situated between the bracelet strands.

The invention will now be explained with the help of the description which follows given by way of example and with the aid of the drawings which illustrate it.

DESCRIPTION OF THE PREFERRED EMBODIMENT

Figure 1:
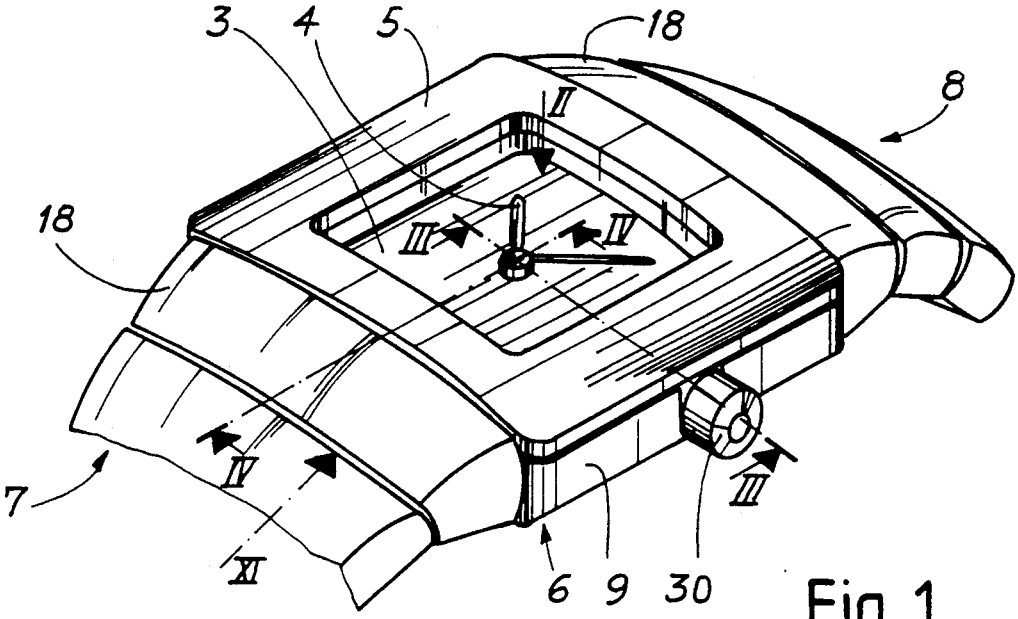
FIG. 1 is a perspective view of the wristwatch according to the invention.

FIG. 1 shows the general aspect of the watch according to the invention. On such figure appear a crystal 5, a dial 3 and hands 4. A back cover 6 is integrally formed with a wing 9 which rises along the side of a caseband bearing a movement, the caseband and the movement not here being visible. Emerging from wing 9 there is seen a crown 30 which serves for setting the time in the watch. FIG. 1 shows that bracelet strand 7, respectively 8, are secured to the wristwatch, parts in the form of a stirrup or ferrule 18 being interposed between the ends of strands 7 and 8 and the wristwatch.

Figure 2:
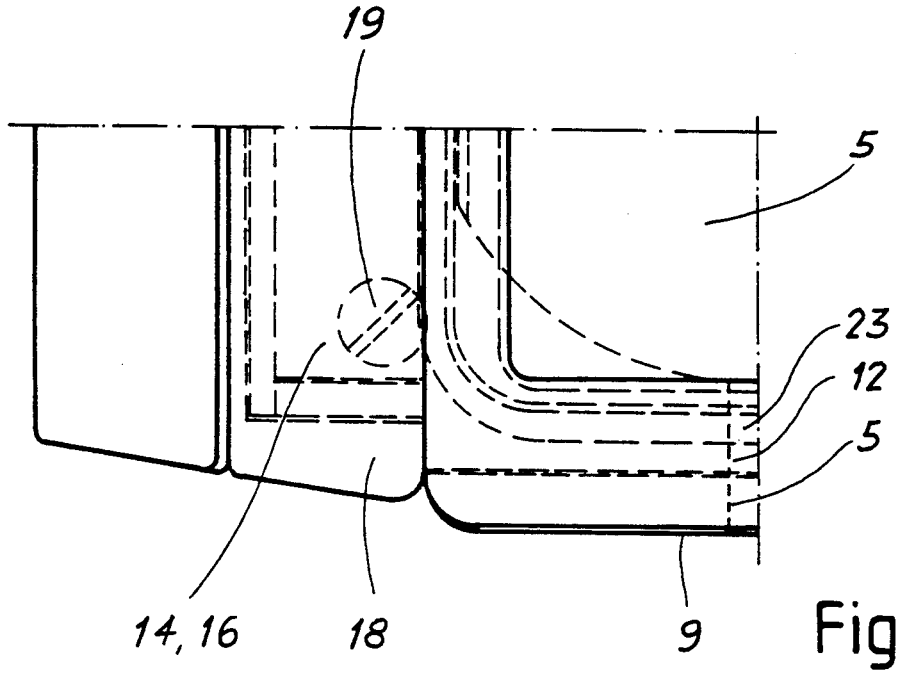
FIG. 2 is a plan view according to arrow II of FIG. 1, such view representing the quarter of the watch located between 3 o'clock and 6 o'clock.
Figure 4:
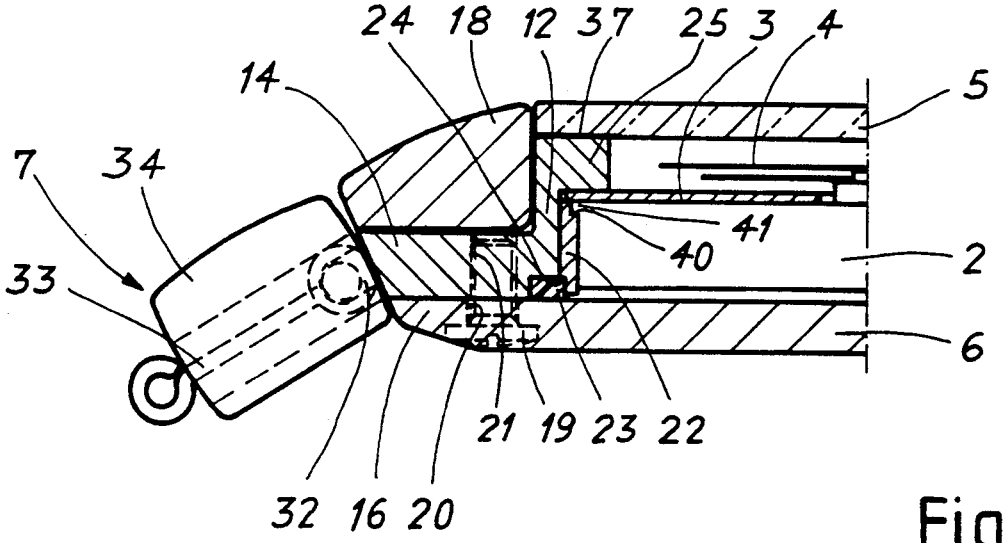
FIG. 4 is a cross-section at 6 o'clock along line IV—IV of FIG. 1.
Figure 3:
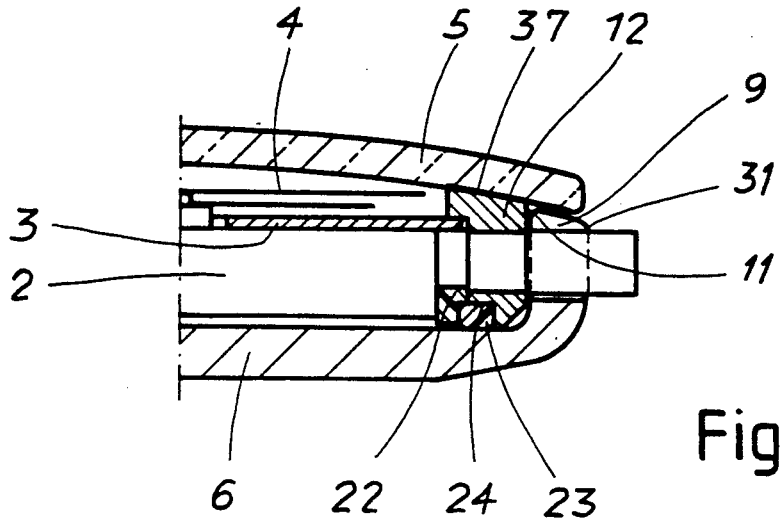
FIG. 3 is a cross-section at 3 o'clock along line III—III of FIG. 1.

If examination is now made of FIGS. 2, 3 and 4 which respectively show a plan view according to arrow II of FIG. 1 and cross-sections according to lines III—III and IV—IV of the same FIG. 1, it is seen that the watch includes a caseband 12 arranged to accommodate a movement 2. The movement is surmounted by a dial 3 and time indicating hands 4. A crystal 5 and a back cover 6 are secured to the caseband 12. A first bracelet strand 7 is secured to the caseband 12 at 6 o'clock as is seen on FIG. 4. A second strand 8, not shown on FIG. 4 (see FIG. 1) is secured to the caseband 12 at 12 o'clock.

Figure 5:
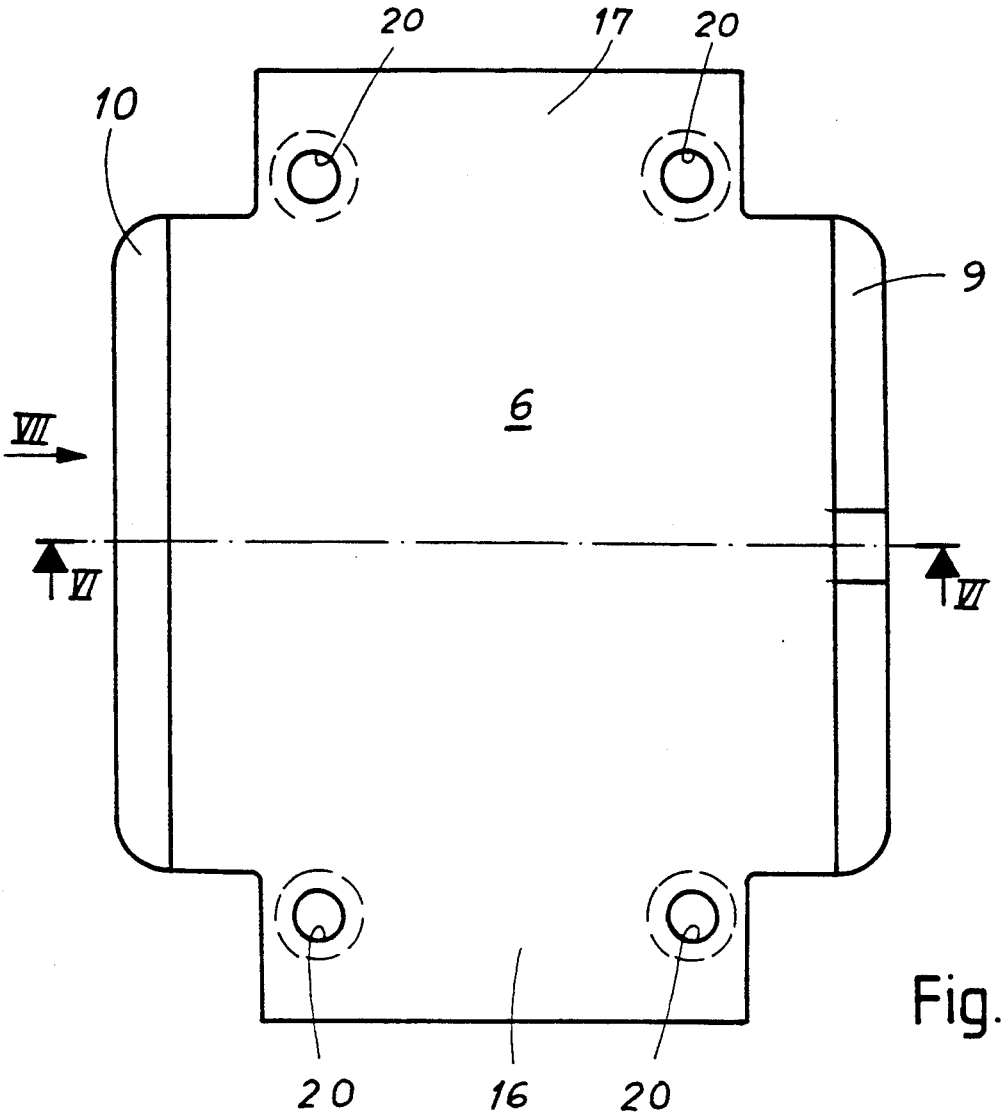
FIG. 5 is a top plan view of the back cover of the watch.
Figure 6:
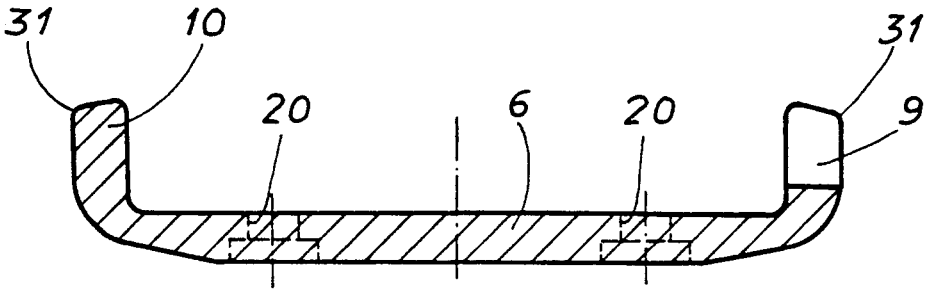
FIG. 6 is a cross-section of the back cover according to line VI—VI of FIG. 5.
Figure 8:
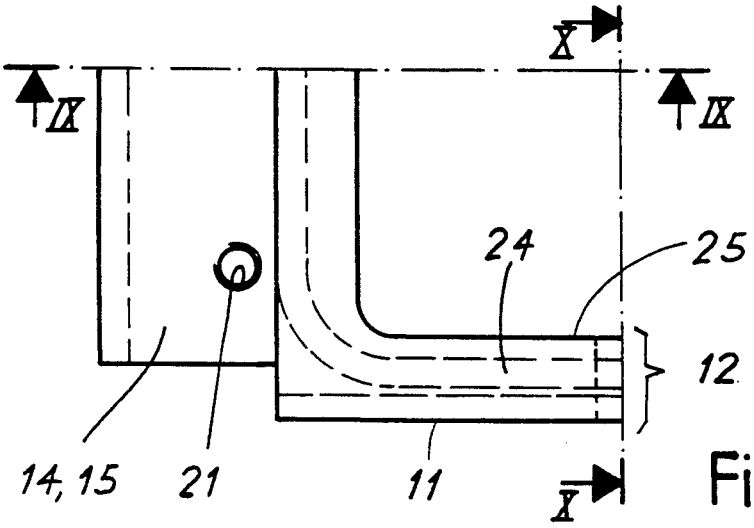
FIG. 8 is a top plan view of the caseband of the watch represented by a quarter located between 3 o'clock and 6 o'clock.
Figure 9:
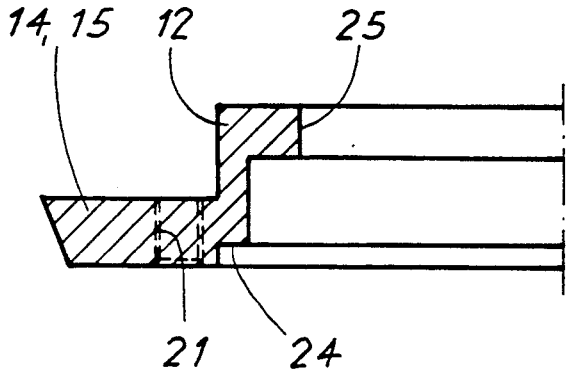
FIG. 9 is a cross-section along line IX—IX of FIG. 8.
Figure 10:
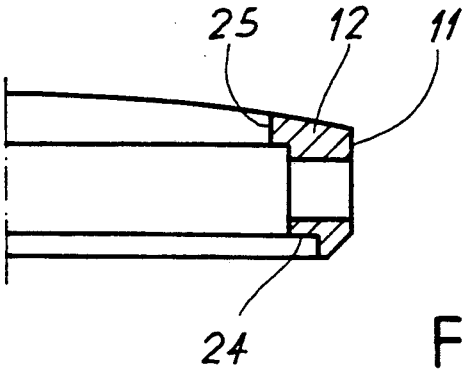
FIG. 10 is a cross-section along line X—X of FIG. 8.

According to an essential feature of the invention, back cover 6 covers over entirely the underside of caseband 12 and includes first and second integrally formed wings, such wings extending at least to cover over entirely the outer sides exhibited by the caseband. The back cover 6 is shown in plan view on FIG. 5 and caseband 12 is likewise shown in plan on FIG. 8. If FIGS. 8 and 5 are superposed, it is noticed that the back cover 6 covers over entirely the underside of caseband 12. On the other hand, FIGS. 5 and 6 show that back cover 6 includes a first wing 9 and a second wing 10 integrally formed with the back cover. Wing 9 covers entirely side 11 of caseband 12 as is seen on FIG. 3 and as is also seen in superposing FIG. 8 and FIG. 5 as well as FIG. 10 and FIG. 6. Wing 10 likewise covers over entirely side 11 of caseband 12, although this is not shown on the drawing, FIG. 8 showing only one quarter—3 o'clock to 6 o'clock —of the caseband 12. It is to be noted that only the outer sides 11 of the caseband which are situated between the ferrules 18 are covered over by wings 9 and 10 of the back cover 6, that is to say, as is readily seen from FIG. 1, the sides located in the 3 o'clock and 9 o'clock zones.

FIG. 3 shows that the first wing 9 is covered over by crystal 5, such latter protruding beyond the caseband 12. The same figure shows that a slight clearance is left between wing 9 and crystal 5, this in order to absorb the differences which may be found in the dimensions of the back cover, above all if this latter is made of moulded sintered material as for example ceramic. Likewise care will be taken to arrange a substantial rounding off of ridge 31 of wing 9 in a manner such that the space between the wing and the crystal are as little apparent as possible.

Figure 12:
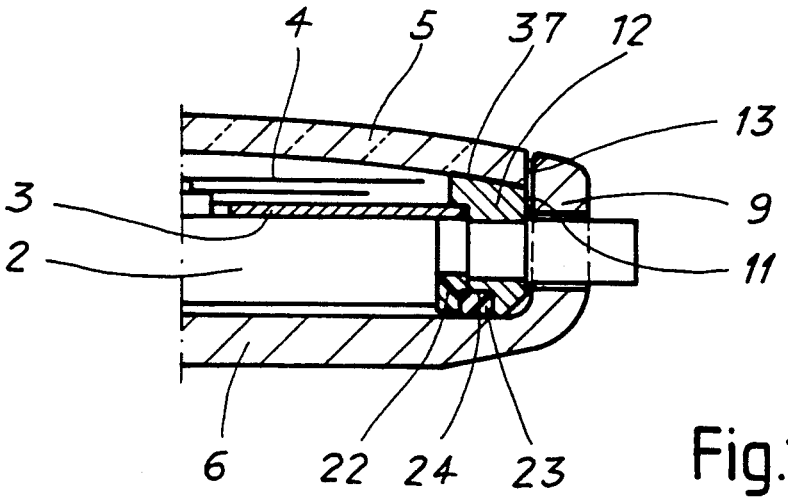
FIG. 12 is a cross-section at 3 o'clock showing a variant of the embodiment of FIG. 3.

FIG. 12 shows a variant in construction relative to that shown on FIG. 3. In FIG. 12 it is seen that wing 9 covers over the side 13 of crystal 5 in a manner such that the side of the crystal is situated flush with the outer side 11 of the caseband 12.

Explanations will now be given on the method of attaching the bracelet strands to the caseband.

Figure 11:
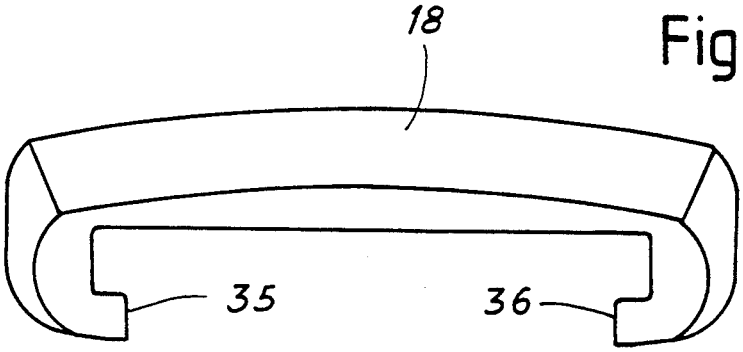
FIG. 11 is a face view of a bracelet link adjoining the case according to arrow XI of FIG. 1

FIGS. 2, 4, 8 and 9 show that the caseband 12 is provided at 6 o'clock with an extension 14 projecting in the longitudinal direction of strand 7. Although not shown, caseband 12 is also provided at 12 o'clock with an extension 15 projecting in the longitudinal direction of strand 8. Extensions 14 and 15 serve as attachment of the strands to the caseband as is seen on FIG. 4. Extension 14 is covered over by an element or ferrule 18 in the form of a stirrup which is independently shown on FIG. 11. Such element is slid over the extension 14 prior to actual assembling of bracelet strand 7. The end of the extension 14 bears a knuckle 32 onto which is articulated a plate 33 provided with hinge pins and arranged to accommodate a first link 34 of strand 7, the latter being movable.

Figure 7:
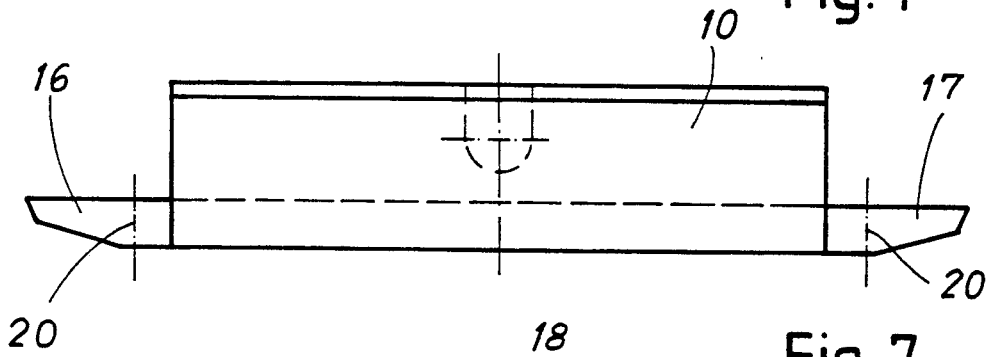
FIG. 7 is a view of the back cover according to arrow VII of FIG. 5.

FIGS. 4, 5 and 7 show that the back cover 6 also includes extensions 16 and 17 which cover over at least partially the extensions 14 and 15 of the caseband 12. Such extensions 16 and 17 occupy the place between the ends 35 and 36 exhibited by stirrup 18 (FIG. 11), stirrup 18 covering the remainder of the caseband extensions which are not covered over by the extensions of the back cover.

Back cover 6 is secured to the caseband 12 by screws 19 (FIG. 4) traversing passages 20 formed in extensions 16 and 17 of the back cover 6, such screws being screwed into threadings 21 formed in the extensions 14 and 15 of caseband 12 (see also FIGS. 2, 5, 6, 7, 8 and 9).

Crystal 5 is secured to the caseband 12 by gluing or soldering (FIGS. 3 to 4). In order to conceal such securing means and at the same time the top of the caseband, metallization 37 is applied under the crystal.

Some comments will now be made on the manner of assembling the movement within the case. A casing ring 22 is interposed between movement 2 and caseband 12 (see also FIGS. 3 and 4). Movement 2 is carried by the bead 41 which it shows, such bead resting in a housing 40 of casing ring 32. A packing 23 is compressed between the back cover 6 and a housing 24 formed at the same time in the casing ring 22 and in the caseband 12 (see FIGS. 8, 9 and 10). The caseband further includes a flange 25 integrally formed therewith. Dial 3 bears against the underside of flange 25 when the back cover is secured to the caseband 12 by means of screws 19. Casing up takes place from below.

The description which has just been given has shown that the watch of the invention is easy to manufacture and exhibits a very light aspect, although possessing strong armour resistant to scratches on condition, as is well understood, that the back cover with its wings is formed in hard metal or ceramic, the hardness of which is equal or greater than 1000 VPH. The links of the bracelet strands are preferably formed in the same material as that employed for the back cover.

It will also be noted that all the functional parts, namely the attachment of the bracelet strands, positioning of the movement and of the crystal, securing of the back cover have to do with the caseband alone, itself formed of the usual metal. The traction due to the bracelet thus is exerted on the caseband and not onto a material poorly adapted to traction forces. If the bracelet strands 7 and 8, ferrules 18 and back cover 6 with its wings 9 and 10 are formed of ceramic, the timepiece shows a unitary appearance, namely that it is outwardly dressed entirely in ceramic evidently with the crystal excepted.

The figures which accompany this text show a case of rectangular form together with a domed crystal. The present invention is certainly not limited to this type of execution given solely by way of example. One could, for instance, have a flat or spherical crystal. One could also use a round or even polygonal case. In these instances, the wings of the back cover would no longer be rectilinear, but rounded or otherwise conformed between the bracelet attachments.

It will be noted finally that the proposed construction is economical, above all by the manner of forming the back cover in a hard and brittle material, such back cover dressing a caseband by rising up along its sides, the mechanical and sealing functions being fulfilled by the metallic caseband.

What we claim is:

1. A wristwatch case including a caseband arranged to receive a movement surmounted by a dial and hands for indicating the time, a crystal and a back cover secured to the caseband and forming therewith a sealed enclosure for said movement, and a bracelet including first and second strands attached to said caseband respectively at 6 o'clock and 12 o'clock, the back cover entirely covering over the caseband underside and including first and second integrally formed wings, said wings extending at least to cover over entirely the outer sides exhibited by the caseband and which are found situated between the bracelet strands.

2. A wristwatch case as set forth in claim 1 in which the caseband is of metal and the back cover is made of a material the hardness of which is equal to or greater than 1000 VPH.

3. A wristwatch case as set forth in claim 1 wherein the first and second wings are covered over by the crystal protruding beyond the caseband.

4. A wristwatch case as set forth in claim 1 wherein the first and second wings cover over the edges exhibited by the crystal, the edges of the crystal being situated flush with the outer edges of the caseband.

5. A wrist watch case including a caseband arranged to receive a movement surmounted by a dial and hands for indicating the time, a crystal and a back cover secured to the caseband and a bracelet including first and second strands attached to said caseband respectively at 6 o'clock and 12 o'clock, the back cover entirely covering over the caseband underside and including first and second integrally formed wings, said wings extending at least to cover over entirely the outer sides exhibited by the caseband and which are found situated between the bracelet strands, said caseband having first and second extensions situated respectively at 6 o'clock and at 12 o'clock, said extensions extending in the longitudinal direction of the bracelet strands in order to serve as attachments of the strands to the caseband and wherein each of said extensions is at least partially covered over by an extension of the back cover, the remainder of said first and second extensions being covered over by an element in the form of a stirrup.

6. A wristwatch case as set forth in claim 5 wherein the back cover is secured to the caseband by screws traversing passages formed in the first and second extensions of the back cover, said screws being screwed into threadings formed in the first and second caseband extensions.

7. A wristwatch case as set forth in claim 1 wherein the crystal is secured to the caseband by glueing or by soldering.

8. A wristwatch case including a caseband arranged to receive a movement surmounted by a dial and hands for indicating the time, a crystal and a back cover secured to the caseband and a bracelet including first and second strands attached to said caseband respectively at 6 o'clock and 12 o'clock, the back cover entirely covering over the caseband underside and including first and second integrally formed wings, said wings extending at least to cover over entirely the outer sides exhibited by the caseband and which are found situated between the bracelet strands, said casing ring being interposed between the movement and the caseband in order to carry the movement, a packing being compressed between the back cover and a housing formed in the ring as well as in the caseband and in which said caseband includes a flange integrally formed therewith, the dial bearing against said flange when the back cover is secured to the caseband.

* * * * *